US007837519B2

(12) United States Patent
Copper et al.

(10) Patent No.: US 7,837,519 B2
(45) Date of Patent: Nov. 23, 2010

(54) ELECTRICAL BUSHING WITH HELPER SPRING TO APPLY FORCE TO CONTACT SPRING

(75) Inventors: Charles Dudley Copper, Hummelstown, PA (US); Henry O. Hermann, Jr., Elizabethtown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/391,524

(22) Filed: Feb. 24, 2009

(65) Prior Publication Data

US 2010/0216354 A1 Aug. 26, 2010

(51) Int. Cl.
*H01R 13/15* (2006.01)

(52) U.S. Cl. ..... 439/839

(58) Field of Classification Search ..... 439/839, 439/842–858

See application file for complete search history.

(56) References Cited

U.S. PATENT DOCUMENTS

| | | | | |
|---|---|---|---|---|
| 3,586,802 | A | 6/1971 | Nichols et al. | |
| 3,587,035 | A | 6/1971 | Kotski | |
| 3,711,800 | A | 1/1973 | Clinton | |
| 3,884,542 | A | 5/1975 | Flatt | |
| 3,930,709 | A | 1/1976 | Stanger et al. | |
| 3,945,699 | A | 3/1976 | Westrom | |
| 3,957,332 | A | 5/1976 | Lambert, III | |
| 3,989,341 | A | 11/1976 | Ball | |
| 4,008,943 | A | 2/1977 | Flatt et al. | |
| 4,066,322 | A | 1/1978 | Brown et al. | |
| 4,068,913 | A | 1/1978 | Stanger et al. | |
| 4,080,033 | A | 3/1978 | Deal | |
| 4,082,403 | A | 4/1978 | Bressler | |
| 4,082,404 | A | 4/1978 | Flatt | |
| 4,082,405 | A | 4/1978 | Stepniak | |
| 4,099,155 | A | 7/1978 | Flatt | |
| 4,113,339 | A | 9/1978 | Eley | |
| 4,116,515 | A | 9/1978 | Spicer | |
| 4,168,393 | A | 9/1979 | Silva | |
| 4,186,985 | A | 2/1980 | Stepniak et al. | |
| 4,192,572 | A | 3/1980 | Stanger et al. | |
| 4,210,381 | A | 7/1980 | Borgstrom | |
| 4,222,625 | A | 9/1980 | Reed | |
| 4,516,823 | A | 5/1985 | Filter et al. | |
| 4,534,610 | A | 8/1985 | Takihara | |
| 4,583,812 | A * | 4/1986 | Gross et al. | 439/839 |
| 4,600,260 | A | 7/1986 | Stepniak | |

(Continued)

FOREIGN PATENT DOCUMENTS

DE 10 2007 029 968 A1 1/2009

(Continued)

OTHER PUBLICATIONS

International Search Report, International Application No. PCT/US2010/000515, International Filing Date Feb. 23, 2010.

*Primary Examiner*—Ross N Gushi

(57) ABSTRACT

An electrical bushing includes a socket that is configured to receive a contact pin and provide an electrical connection between the contact pin and a connection terminal. The socket includes a contact spring that is configured to make contact with the contact pin when the contact pin is inserted into the socket. A helper spring of the electrical bushing abuts an outer surface of the contact spring to apply a force to the contact spring.

23 Claims, 7 Drawing Sheets

U.S. PATENT DOCUMENTS

| | | | | |
|---|---|---|---|---|
| 4,713,018 | A | | 12/1987 | Sutton |
| 4,773,872 | A | | 9/1988 | Borgstrom et al. |
| 4,822,291 | A | | 4/1989 | Cunningham |
| 4,863,392 | A | | 9/1989 | Borgstrom et al. |
| 4,913,658 | A | | 4/1990 | Borgstrom et al. |
| 5,203,849 | A | | 4/1993 | Balsells |
| 5,221,220 | A | | 6/1993 | Roscizewski |
| 5,277,605 | A | | 1/1994 | Roscizewski et al. |
| 5,309,313 | A | | 5/1994 | Yaworski et al. |
| 5,393,240 | A | | 2/1995 | Makal et al. |
| 5,421,751 | A | | 6/1995 | Bennett et al. |
| 5,445,533 | A | | 8/1995 | Roscizewski et al. |
| 5,525,069 | A | | 6/1996 | Roscizewski et al. |
| 5,545,842 | A | | 8/1996 | Balsells |
| 5,676,571 | A | | 10/1997 | Matthews |
| 5,938,486 | A | * | 8/1999 | Durand-Cochet et al. ... 439/839 |
| 6,024,611 | A | * | 2/2000 | Giuseppe ..... 439/819 |
| 6,062,918 | A | | 5/2000 | Myer et al. |
| 6,280,245 | B1 | | 8/2001 | Han |
| 6,416,338 | B1 | | 7/2002 | Berlovan |
| 6,966,802 | B2 | | 11/2005 | Hielscher et al. |
| 7,077,672 | B2 | | 7/2006 | Krause et al. |
| 7,186,121 | B1 | | 3/2007 | Costello et al. |
| 7,341,468 | B2 | | 3/2008 | Hughes et al. |
| 7,494,355 | B2 | | 2/2009 | Hughes et al. |
| 7,568,927 | B2 | | 8/2009 | Hughes et al. |
| 2006/0270277 | A1 | | 11/2006 | Zhao et al. |
| 2008/0232014 | A1 | | 9/2008 | Bock et al. |

FOREIGN PATENT DOCUMENTS

| | | |
|---|---|---|
| GB | 1 528 482 | 10/1978 |
| WO | WO 2006/124969 A2 | 11/2006 |

* cited by examiner

ELECTRICAL BUSHING WITH HELPER SPRING TO APPLY FORCE TO CONTACT SPRING

RELATED APPLICATIONS

This application is related to U.S. patent application Ser. No. 12/391,535, filed Feb. 24, 2009 and titled "Electrical Bushing with Radial Interposer Spring," and U.S. patent application Ser. No. 12/391,553, filed Feb. 24, 2009 and titled "Electrical Connector with Slider Component for Fault Condition Connection," the entirety of each of which is hereby incorporated by reference.

BACKGROUND

1. Technical Field

This application relates to electrical devices and, more particularly, to electrical connectors.

2. Related Art

An electrical connector may be used to connect multiple electrical devices. One type of electrical connector is an electrical bushing that may connect a power distribution component with a power line. A first end of the bushing may include a connection terminal that connects with the power distribution component, such as a transformer. A second end of the bushing may include an opening that receives a contact pin associated with the power line. The bushing includes a current path to electrically connect the power distribution component with the power line when the contact pin is inserted into the bushing.

In a standard connection, the contact pin is inserted into the bushing until a connection is made between the contact pin and a socket in the bushing. Once the standard connection is complete, current flows through the bushing between the power distribution component and the power line. The socket may include one or more contact springs that make contact with the contact pin when the contact pin is inserted into the socket. The contact springs may be formed from a conductive material (e.g., copper, a copper alloy such as tellurium copper, or another highly conductive material).

Although these contact spring materials may be desirable for their conductive properties, they may also be susceptible to stress relaxation. Contact springs that are susceptible to stress relaxation may deform in response to a long-term contact with the contact pin. Over time, the contact force provided by the contact springs against the contact pin may diminish. A lesser contact force may result in a greater chance that the contact spring will disconnect from the contact pin. If the electrical connection between the contact pin and the socket is broken, then a power failure may occur on the power line. Therefore, a need exists for an electrical bushing with an improved connection with the contact pin.

SUMMARY

An electrical bushing may connect multiple electrical devices. In one implementation, an electrical bushing includes a socket that is configured to receive a contact pin and provide an electrical connection between the contact pin and a connection terminal. The socket includes a contact spring that is configured to make contact with the contact pin when the contact pin is inserted into the socket. A helper spring of the electrical bushing abuts an outer surface of the contact spring to apply a force to the contact spring.

In another implementation, an electrical bushing includes means for receiving a contact pin and electrically connecting the contact pin and a connection terminal. The means for receiving includes a cantilever spring finger that is configured to make contact with the contact pin. The electrical bushing also includes means for applying a force to the cantilever spring finger to help maintain contact between the cantilever spring finger and the contact pin.

In yet another implementation, an electrical bushing is provided for connecting a power distribution component with a power line. The electrical bushing includes a connection terminal configured to electrically connect with the power distribution component. A socket of the electrical bushing is configured to receive a contact pin associated with the power line and provide an electrical connection between the contact pin and the connection terminal. The socket includes a contact spring that is configured to make contact with the contact pin when the contact pin is inserted into the socket. The electrical bushing also includes a helper spring that abuts the contact spring to apply a force to the contact spring to help maintain contact between the contact spring and the contact pin.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION OF THE PREFERRED EMBODIMENTS

An electrical connector may be used to connect multiple electrical devices. The electrical connector may include a socket that receives a contact pin associated with one of the electrical devices. When the contact pin is being inserted in the electrical connector, either a standard connection or a fault condition connection may occur. In a standard connection, the socket receives the contact pin and provides a long-term current path between the contact pin and an external device connected with the electrical connector. In a fault condition connection, there may be a problem somewhere in the system that may cause a much higher current flow and subsequent electric arc. The electrical connector includes a slider component that is able to move relative to the socket. In a fault condition connection, the slider component may move relative to the socket to make contact with the contact pin and extinguish possible electric arcs caused during the fault condition connection.

Figure 1:
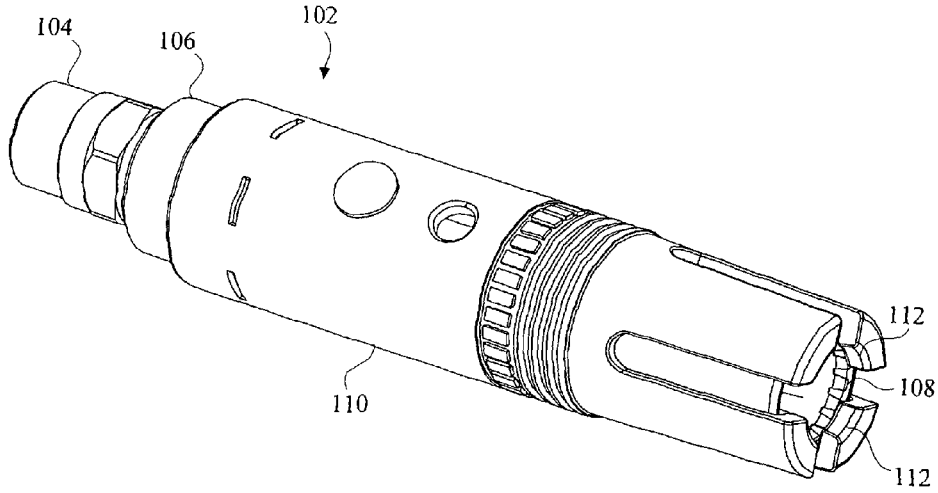
FIG. 1 illustrates an electrical connector with a slider component in a standard position.

FIG. 1 illustrates an electrical connector 102. The electrical connector 102 may be an electrical bushing for connection of multiple electrical devices. In one implementation, the electrical connector 102 may connect an electrical device with a power line that carries electricity to or from the electrical device. One end of the electrical connector 102 may connect with the electrical device, and another end of the electrical connector 102 may receive a contact pin associated with the power line.

The electrical connector 102 may include a connection terminal 104, a core component 106, a socket 108, and a slider component 110. The socket 108 provides a primary current path between the connection terminal 104 and a contact pin inserted into the socket 108 during a standard connection. The slider component 110 may move relative to the socket 108 to make contact with the contact pin and provide a primary current path between the connection terminal 104 and the contact pin during a fault condition connection. The primary current path through the slider component 110 in the fault condition connection is different than the primary current path through the socket 108 in the standard connection. Also, the primary contact interface (e.g., the socket 108) between the electrical connector 102 and the contact pin in the standard connection is different than the primary contact interface (e.g., the slider component 110) between the electrical connector 102 and the contact pin in the fault condition connection. A fault condition connection may result when the contact pin is inserted into the electrical connector 102 and there is a problem in the system. The problem may cause a much higher current flow than experienced in the standard connection. The electrical connector 102 may serve as a fault current bushing that attempts to minimize harm caused during a fault condition connection.

The electrical connector 102 may be used to connect power distribution equipment, such as transformers, switch gear, power lines, or other electrical devices. The electrical connector 102 in one implementation may be a 15 kilovolt 200 amp switch with a gas actuated slider which provides a 10 kiloamp 10 cycle fault closure capability. In one implementation, the electrical connector 102 may be part of an underground residential 200 amp medium voltage distribution circuit. The voltage level experienced at the electrical connector 102 may be greater than 10 kilovolts. For example, the electrical connector 102 may experience voltage levels from about 15 kilovolts to about 35 kilovolts in some implementations. In other implementations, the electrical connector 102 may experience other voltage levels or may be part of another type of power distribution system.

The electrical connector 102 may connect a transformer (e.g., a padmount transformer) with a power line. The transformer may be a single phase transformer that includes one electrical connector like the electrical connector 102 as a first terminal and another electrical connector like the electrical connector 102 as a second terminal. In another implementation, the electrical connector 102 may be used with a three phase transformer that includes six electrical connectors like the electrical connector 102 as terminals.

The connection terminal 104 may connect with an external electrical device, such as a transformer, switch, or other power distribution component. The connection terminal 104 may serve as an interface between the external electrical device and the rest of the electrical connector 102. The connection terminal 104 may be formed of a conductive material. Current may flow between the external electrical device and the electrical connector 102 through the connection terminal 104. The connection terminal 104 may define an opening that accepts an electrical contact associated with the external electrical device. The opening may be threaded to receive a corresponding threaded electrical contact associated with the external electrical device.

The core component 106 may be electrically connected with the connection terminal 104. Current may flow between the connection terminal 104 and the core component 106. In one implementation, the core component 106 and the connection terminal 104 are separate components. In another implementation, the core component 106 and the connection terminal 104 are parts of one unitary component. For example, the connection terminal 104 may be the portion of the core component 106 that connects with an external electrical device, such as a power distribution component.

The core component 106 may also be electrically connected with the socket 108. Current may flow between the core component 106 and the socket 108. In one implementation, the core component 106 and the socket 108 are separate components. In another implementation, the core component 106 and the socket 108 are parts of one unitary component. For example, the socket 108 may be the portion of the core component 106 that connects with a contact pin, such as a contact pin associated with a power line.

The socket 108 may serve as an interface between the contact pin and the rest of the electrical connector 102. The socket 108 may be formed of a conductive material. Current may flow between the electrical connector 102 and the contact pin through the socket 108. The socket 108 may define an opening that accepts a contact pin associated with a power line.

When the contact pin is inserted into the electrical connector 102 and a standard connection results, the socket 108 mechanically and electrically connects with a conductive portion of the contact pin. When the contact pin is inserted into the electrical connector 102 and a fault condition connection results, the socket 108 may not mechanically connect with the conductive portion of the contact pin in some instances. The fault condition may prevent a lineman from inserting the contact pin all the way into the socket 108. For example, the expanding gas associated with an electric arc created in a fault condition may make it difficult to insert the contact pin into the socket 108.

The electric arc may be extinguished when a physical connection is made with the conductive portion of the contact pin. The socket 108 may be unable to move towards the contact pin to make the physical connection with the contact pin. For example, the socket 108 may be held in a fixed position relative to the core component 106 and the connection terminal 104. Therefore, the slider component 110 may be used to make a connection with the conductive portion of the contact pin to extinguish the electric arc. For example, the slider component 110 may move in a longitudinal direction relative to the socket 108 in response to occurrence of a fault condition to make physical contact with the contact pin. The increase in gas pressure caused by the electric arc may be used to propel the slider component 110 forward until the slider component 110 makes contact with the conductive portion of the contact pin. Therefore, the electrical connector 102 may serve as a fault current bushing that is configured to handle both standard connections and fault condition connections. The fault current bushing includes the socket 108 to make contact with the contact pin in a standard connection and the slider component 110 to make contact with the contact pin in the fault condition connection.

After the slider component 110 makes contact with the contact pin, the slider component 110 provides a current path between the contact pin and the connection terminal 104. Because the current flows through the slider component 110 in the fault condition connection, the current path provided in the fault condition connection is different than the current path provided during a standard connection. In the standard connection, the current generally flows through the socket 108 and does not substantially flow through the slider component 110.

In some implementations, the socket 108 remains in a substantially fixed position relative to the connection terminal 104 in a standard connection and a fault condition connection. Holding the socket 108 in a fixed position relative to the core component 106 and the connection terminal 104 may limit the number of contact interfaces required to maintain an electrical path between the socket 108 and the connection terminal 104. For example, in implementations where the socket 108 is free to move relative to the core component 106 and the connection terminal 104, one or more additional contact interfaces may need to be inserted into the current path to allow the movement of the socket 108.

The number of contact interfaces in the primary long-term current path may be minimized by holding the socket 108 in a fixed position and allowing the slider component 110 to move to make contact with the contact pin in fault condition connections. For example, the current path between an external device connected with the connection terminal 104 and the contact pin inserted into the socket 108 during the standard connection may consist of only two contact interfaces: (1) the contact interface between the external device and the connection terminal 104; and (2) the contact interface between the socket 108 and the contact pin. In some implementations, the current path between the connection terminal 104 and the socket 108 does not include any contact interfaces. For example, the socket 108 may be integrally connected with the connection terminal 104 as one unitary component. Other implementations may include additional contact interfaces allowing the socket 108 to move.

In fault condition connections, the current path between an external device connected with the connection terminal 104 and the contact pin may consist of three contact interfaces: (1) the contact interface between the external device and the connection terminal 104; (2) the contact interface between the core component 106 and the slider component 110; and (3) the contact interface between the slider component 110 and the contact pin.

The slider component 110 may include one or more electrical contacts 112 that make contact with the contact pin inserted into the electrical connector 102. In a fault condition connection, the electrical contacts 112 are used to make physical contact with a conductive portion of the contact pin to extinguish an electric arc created during a fault condition connection. When the slider component 110 is propelled forward, the electrical contacts 112 make the first connection with the conductive portion of the contact pin. After physical connection is made, the fault current will flow through the slider component 110 rather than through some other medium, such as air.

In a standard connection, the contacts 112 of the slider component 110 may serve another purpose. The contacts 112 may be positioned so that they extend past the socket 108 in a longitudinal direction, as shown in FIG. 1. In a standard connection, the contacts 112 of the slider component 110 may serve as a preliminary point of arc discharge with the contact pin before the contact pin is fully inserted into the socket 108. For example, the contacts 112 of the slider component 110 may make physical or electrical contact with the contact pin. As the contact pin is inserted into the electrical connector 102, the contact pin will reach the contacts 112 of the slider component 110 before reaching the contacts of the socket 108. During insertion of the contact pin, an electric arc may be formed even in a standard connection with normal current levels. Because the electrical contacts 112 may serve as a preliminary point of arc discharge with the contact pin before the contact pin reaches the socket 108, the electrical contacts 112 may attract at least a portion of the electric arc from the contact pin. Therefore, the contacts 112 may be positioned to shield the socket 108 from electric arc damage during connection of the contact pin with the socket 108 in a standard connection. The contacts 112 may not be part of the long-term current path for the standard connection between the contact pin and the socket 108. Therefore, localizing the electric arc damage to the contacts 112 of the slider component 110 instead of the allowing the arc to damage the contacts of the socket 108 may result in a more reliable long-term connection through the electrical connector 102.

Figure 2:
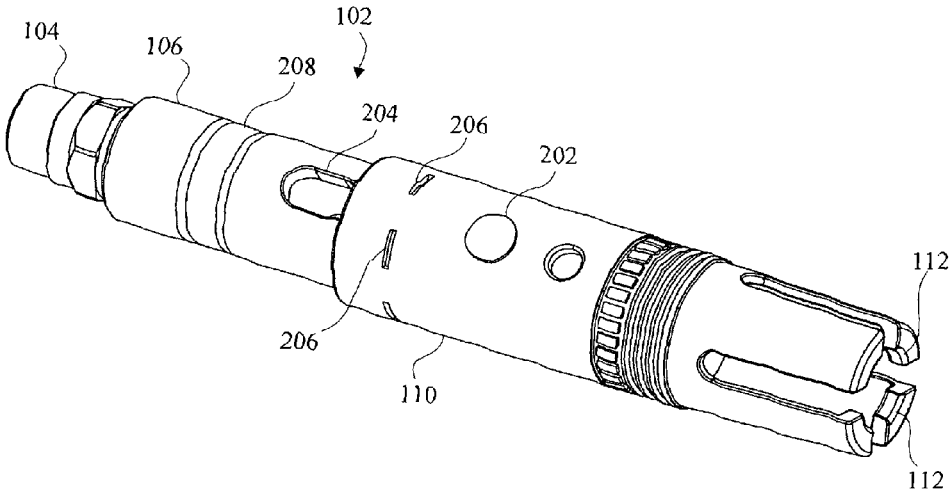
FIG. 2 illustrates an electrical connector with a slider component in an extended position.

FIG. 1 illustrates the electrical connector 102 with the slider component 110 in a standard position. For example, FIG. 1 shows the electrical connector 102 before occurrence of a fault condition connection. FIG. 2 illustrates the electrical connector 102 with the slider component 110 in an extended position. For example, FIG. 2 may show the electrical connector 102 after occurrence of a fault condition connection.

The electrical connector 102 may include a guide component that guides the slider component 110 when the slider component 110 moves in a longitudinal direction during a fault condition connection. The guide component may guide the slider component 110 from a first position to a second position to connect with the contact pin in a fault condition connection. For example, the guide component may guide the slider component 110 from a position where the slider component 110 is fixed with the core component 106 to a position where the slider component 110 has connected with the conductive portion of the contact pin inserted into the electrical connector 102.

The guide component may be a protuberance/slot system. In one implementation, the slider component 110 includes a protuberance 202 and the core component 106 defines a slot 204, as shown in FIG. 2. The slider component 110 is disposed around at least a portion of the core component 106. The protuberance 202 may be a pin, bump, or other protrusion. In one implementation, the protuberance 202 and the slider component 110 are separate components. For example, the protuberance 202 may be a pin that is inserted through the slider component 110. In another implementation, the protuberance 202 and the slider component 110 are parts of one unitary component. For example, the protuberance may be formed on a surface of the slider component 110.

The slot 204 may be an indentation, guide rail, or other channel. In one implementation, the slot 204 may be formed in the outer surface of the core component 106. In another implementation, the slot 204 may pass through to a hollow center of the core component 106. Alternatively, the slot 204 may be formed from one or more raised borders on the outer surface of the core component 106. The slot 204 and the core component 106 may be separate components that are joined together or may be parts of one unitary component. The protuberance 202 travels along the slot 204 when the slider component 110 moves relative to the core component 106 and the socket 108. The slot 204 includes an end portion that stops the movement of the slider component 110 when the protuberance 202 reaches the end portion of the slot 204.

The electrical connector 102 may also include a connection component 206. The connection component 206 restrains the slider component 110 from moving relative to the core component 106 and the socket 108 before occurrence of a fault condition. The connection component 206 may release the slider component 110 in response to a force created during a fault condition. After the connection component 206 releases the slider component 110, the slider component 110 is free to move relative to the core component 106 and the socket 108.

In one implementation, the connection component 206 may be a crimped connection between the core component 106 and the slider component 110. For example, a portion of the slider component 110 may be crimped to make contact with the core component 106. The core component 106 may define a recess 208 or other component to engage the slider component 110. In one implementation, the connection component 206 may be a protuberance/recess connection between the slider component 110 and the core component 106. The protuberance may stick out from the slider component 110, and the core component 106 may include a corresponding recess (e.g., the recess 208). Alternatively, the protuberance may extend from the core component 106 while the slider component 110 has the corresponding recess.

The connection component 206 may be designed so that the slider component 110 is held in place under standard connection conditions, but is released when a fault condition occurs. For example, the size and shape of the protuberance and recess may be designed to disengage upon experiencing a certain minimum force. The size and shape may be selected so that a minimum amount of force created by gas expansion in an electric arc fault current situation would disengage the slider component 110 from the core component 106. For example, the size and shape of the protuberance and recess may be selected so that they disengage in response to about 100 pounds of force. Other implementations may be designed to disengage in response to other amounts of force. The gas expansion force may then propel the slider component 110 in a longitudinal direction along the length of the electrical connector 102 to make contact with a contact pin.

Figure 3:
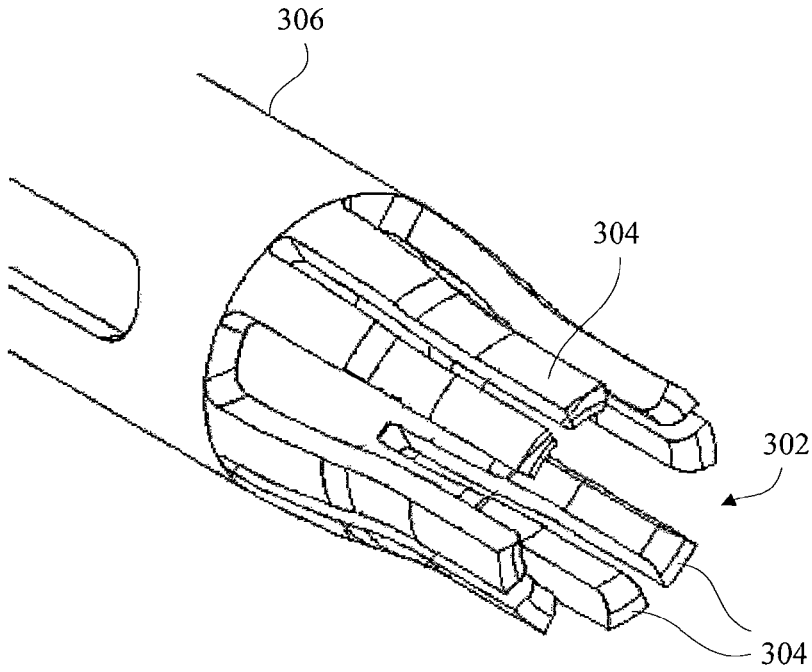
FIG. 3 illustrates a socket of an electrical connector.

FIG. 3 illustrates a socket 302 of an electrical connector. The socket 302 may also be used with the electrical connector 102 of FIG. 1. For example, the socket 302 may be used in place of the socket 108 shown in FIG. 1. Alternatively, the socket 302 may be used with other electrical connectors.

The socket 302 may receive a contact pin and provide an electrical connection between the contact pin and a connection terminal, such as the connection terminal 104 of FIG. 1. The socket 302 includes one or more contact springs 304 attached to a body portion of the socket 302. FIG. 3 illustrates a socket that includes eight contact springs 304. Other implementations may include less or more contact springs 304 than the socket shown in FIG. 3. The body portion of the socket 302 may be a core component 306 of the electrical connector, similar to the core component 106 of the electrical connector 102 of FIG. 1. The contact springs 304 serve to make contact with the contact pin when the contact pin is inserted into the socket 302. The contact springs 304 carry current between the received contact pin and the connection terminal.

The contact springs 304 may be shaped as cantilever spring fingers. One end of a cantilever spring finger may be connected to the body portion of the socket 302. The other end of the cantilever spring finger may be free to apply a force against the contact pin to maintain an electrical connection with the contact pin. In other implementations, the contact springs 304 may be designed in another configuration.

The contact springs may be formed from a conductive material (e.g., copper, a copper alloy such as tellurium copper, or another highly conductive material). Although these contact spring materials may be desirable for their conductive properties, they may also be susceptible to stress relaxation. Over time, the contact force provided by the contact springs 304 against the contact pin may diminish.

Figure 4:
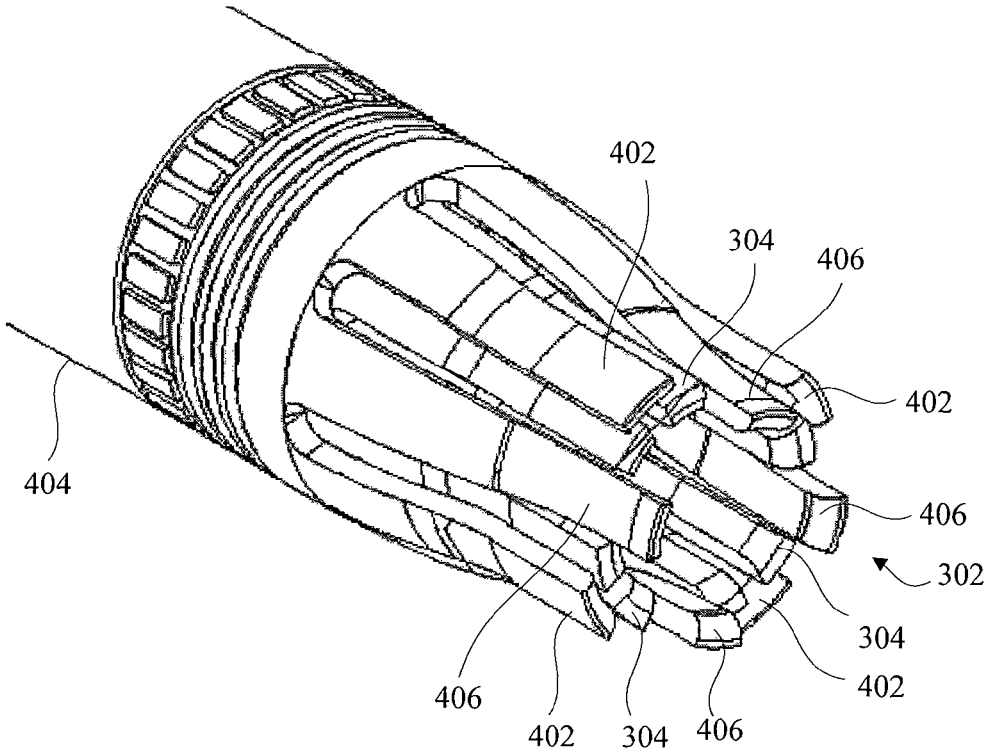
FIG. 4 illustrates helper springs that abut contact springs of the socket of FIG. 3.

FIG. 4 illustrates one or more helper springs 402 that abut the contact springs 304 of the socket 302 shown in FIG. 3. The helper springs 402 abut an outer surface of the contact springs 304 to apply a force to the contact springs 304. The helper springs 402 apply the force to the outer surface of the contact springs 304 to help maintain contact between the contact springs 304 and the contact pin. The contact springs 304 may carry current between the contact pin and the connection terminal during a standard connection. In one implementation, the helper springs 402 do not carry substantial current between the contact pin and the connection terminal during a standard connection. For example, a majority of the current may flow through the contact springs 304 instead of through the helper springs 402 during a standard connection.

The helper springs 402 may be shaped as cantilever spring fingers. One end of the cantilever spring fingers may be connected to a support structure. The support structure may be a slider component 404, similar to the slider component 110 of FIG. 1. In implementations where the helper springs 402 are connected with the slider component 404, the helper springs 402 move relative to the contact springs 304 when the slider component 404 moves relative to the socket 302. The other end of the cantilever spring fingers may be free to apply a force against the contact springs 304 to help the contact springs 304 maintain an electrical connection with the contact pin. The helper springs 402 may apply the force at any point along the contact springs 304. In one implementation, the helper springs 402 apply the force to a portion of the contact springs 304 substantially near the free ends of the cantilevered contact springs 304. In other implementations, the helper springs 402 may be designed in another configuration.

In one implementation, the helper springs 402 are formed from the same material as the contact springs 304. In another implementation, the helper springs 402 are formed from a different material than the contact springs 304. The helper springs 402 may be formed from a material that is more resistant to stress relaxation than the material used to form the contact springs 304. For example, if the contact springs 304 are formed from copper or a copper alloy, then the helper springs 402 may be formed from a material that does not include copper or a copper alloy. Other implementations may use copper or a copper alloy to form the helper springs 402. The helper springs may be formed from brass, phosphor copper, beryllium copper, steel, or another material.

In one implementation, one of the helper springs 402 abuts and applies a force to one of the contact springs 304. For example, there may be a one-to-one ratio between the helper springs 402 and the contact springs 304. In this implementation, each helper spring 402 may apply a force to a single contact spring 304. In another implementation, one helper spring 402 may apply a force to multiple contact springs 304.

For example, each of the helper springs 402 may apply a force to the outer surface of two or more different contact springs 304, as shown in FIG. 4.

In addition to the helper springs 402, FIG. 4 also illustrates longer contact fingers 406 that extend from the slider component 404. The contact fingers 406 make contact with a contact pin inserted into the electrical connector. In a fault condition connection, the contact fingers 406 are used to make physical contact with a conductive portion of the contact pin to extinguish an electric arc created during a fault condition connection. When the slider component 404 is propelled forward, the contact fingers 406 make the first connection with the conductive portion of the contact pin. After physical connection is made, the fault current will flow through the slider component 404 rather than through some other medium, such as air.

In a standard connection, the contact fingers 406 may serve another purpose. The contact fingers 406 may be positioned so that they extend past the socket 302 in a longitudinal direction. In a standard connection, the contact fingers 406 may serve as a preliminary point of electrical contact with the contact pin before the contact pin is fully inserted into the socket 302. As the contact pin is inserted into the electrical connector, the contact pin will reach the contact fingers 406 before reaching the contacts of the socket 302. During insertion of the contact pin, an electric arc may be formed even in a standard connection with normal current levels. Because the contact fingers 406 may serve as a preliminary point of contact with the contact pin before the contact pin reaches the socket 302, the contact fingers 406 may attract at least a portion of the electric arc from the contact pin. Therefore, the contact fingers 406 may be positioned to shield the socket 302 and the contact springs 304 from electric arc damage during connection of the contact pin with the socket 302 in a standard connection. In some implementations, the contact fingers 406 may not be a primary part of the long-term current path for the standard connection between the contact pin and the socket 302. Therefore, localizing the electric arc damage to the contact fingers 406 of the slider component 110 instead of the allowing the arc to damage the contact springs 304 of the socket 302 may result in a more reliable long-term connection through the electrical connector.

Figure 5:
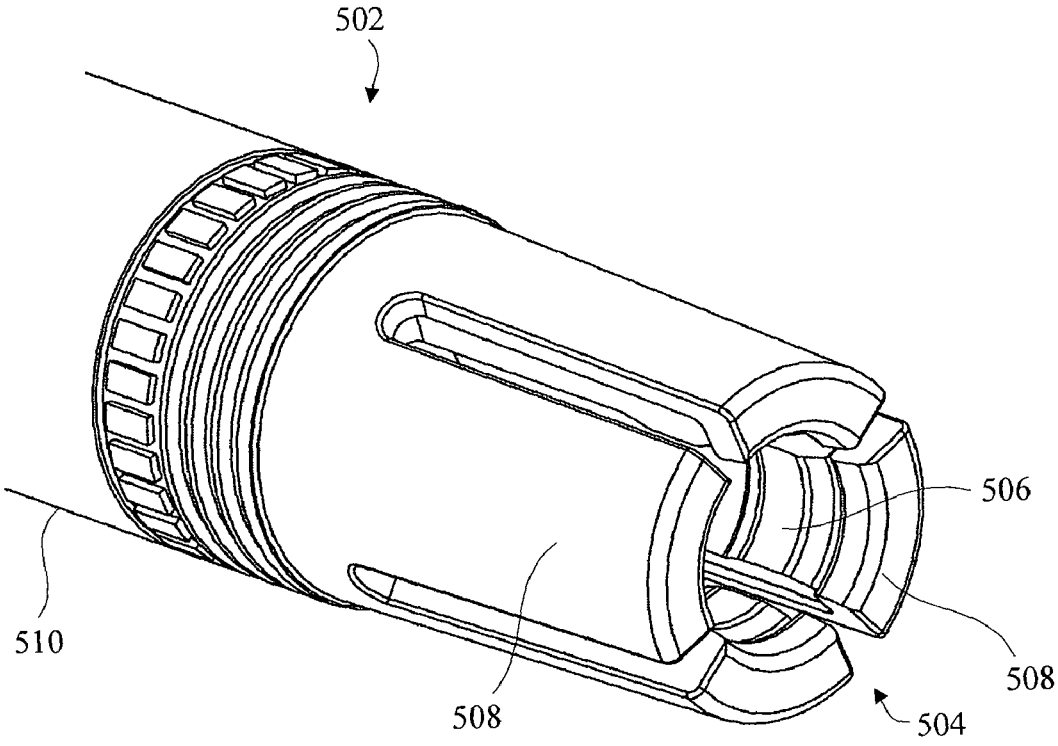
FIG. 5 illustrates another embodiment of helper springs that abut contact springs of a socket.

FIG. 5 illustrates another embodiment an electrical connector 502 with a socket 504. The socket 504 may include contact springs 506, similar to the contact springs 304 described above in connection with FIG. 3. The electrical connector 502 may include helper springs 508 that abut the contact springs 506 of the socket 504. The helper springs 508 abut an outer surface of the contact springs 506 to apply a force to the contact springs 506. The helper springs 508 apply the force to the outer surface of the contact springs 506 to help maintain contact between the contact springs 506 and the contact pin. The helper springs 508 may be connected on one end to a support component, such as a body portion of a slider component 510. The slider component 510 may be similar to the slider component 110 shown in FIG. 1.

Figure 6:
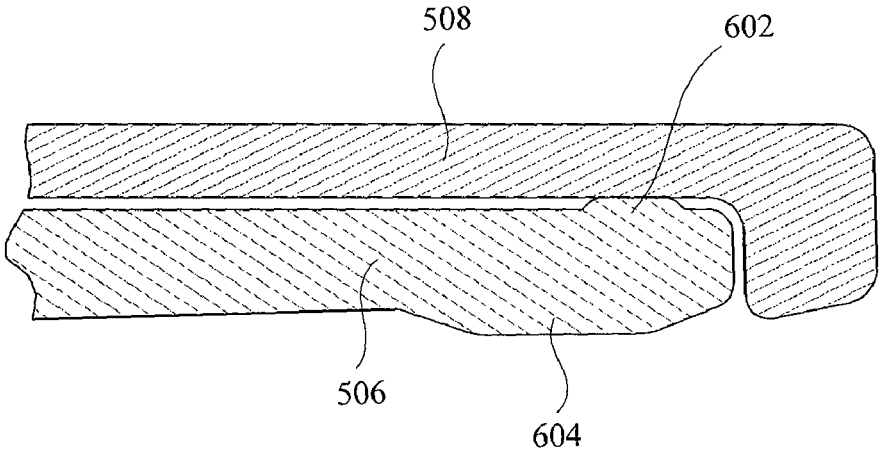
FIG. 6 illustrates a cross-sectional view of a helper spring and a contact spring of the socket of FIG. 5.

FIG. 6 illustrates a cross-sectional view of one of the helper springs 508 and one of the contact springs 506 from the socket of FIG. 5. The contact spring 506 may include a raised portion 602 to make contact with the helper spring 508. The raised portion 602 defines the location where the helper spring 508 will apply the force to the contact spring 506. Alternatively, the helper spring 508 may include a raised portion to make contact with the contact spring 506. In other implementations, both the contact spring 506 and the helper spring 508 include raised portions to define the point of contact. In still other implementations, the electrical connector may include multiple raised portions that define multiple points of contact between the contact spring 506 and the helper spring 508. The contact spring 506 may also include another raised portion 604 to make contact with the contact pin when the contact pin is inserted into the socket 504 shown in FIG. 5.

Figure 7:
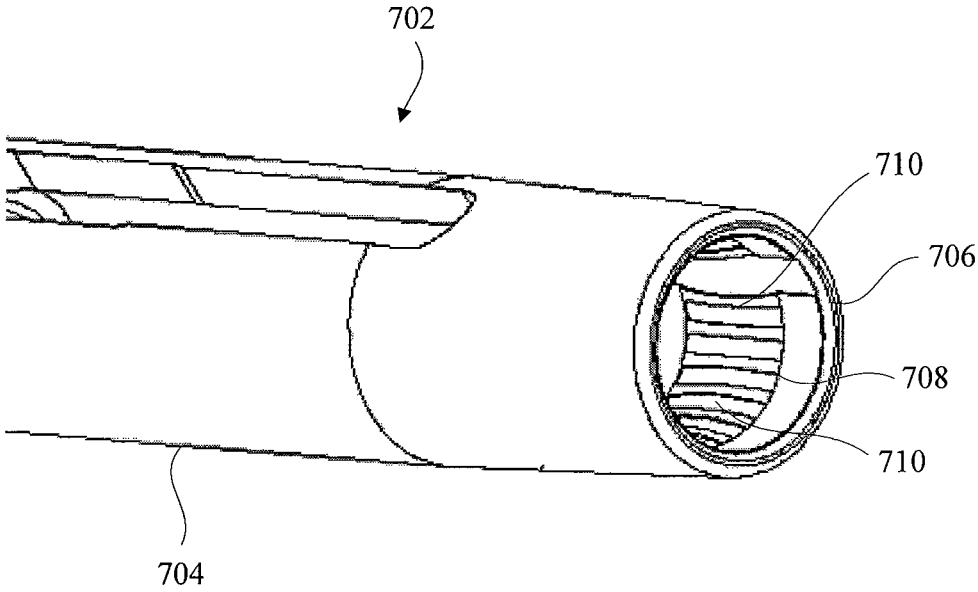
FIG. 7 illustrates another embodiment of a socket of an electrical connector.

FIG. 7 illustrates another embodiment of an electrical connector 702. The electrical connector includes a core component 704 that defines a socket 706. The socket 706 may include an opening leading to a hollow area of the core component 704. The socket 706 is configured to receive a contact pin, such as a contact pin associated with a power line. The socket 706 includes a radial interposer spring 708 that makes contact with the contact pin inserted into socket 706. The radial interposer spring 708 is configured to complete an electrical connection between the contact pin and the core component 704 when the contact pin is inserted into the socket 706. The socket 706 may be used with other electrical connectors, such as the electrical connector 102 shown in FIG. 1. For example, the socket 706 may be used in place of the socket 108 shown in FIG. 1.

The radial interposer spring 708 may be compressed between the contact pin and the core component 704 when the contact pin is inserted into the socket 706. When the contact pin is inserted into the socket 706, the contact pin may exert a force on the radial interposer spring 708 that is orthogonal to the surface of the contact pin. Because the radial interposer spring 708 is compressed between the contact pin and the core component 704, the inner surface of the core component 704 will apply a response force to the radial interposer spring 708. The response force may be substantially equal in magnitude and substantially opposite in direction as compared to the force applied from the contact pin.

The radial interposer spring 708 may provide a large number of redundant connection points between the core component 704 and the contact pin. The radial interposer spring 708 may include twenty or more spring components that make contact with the contact pin when the pin is inserted into the socket 706. For example, the radial interposer spring 708 may include multiple slats 710 that are configured to make contact with the contact pin when the contact pin is inserted into the socket 706. The slats 710 may be strips of conductive material disposed between two support components. The support components may be used to connect the radial interposer spring 708 with the inner surface of the core component 704 while the slats 710 are used to make an electrical connection with the contact pin. The radial interposer spring 708 may define openings between each of the slats 710.

In one implementation, the radial interposer spring 708 may be a contact band formed into a substantially circular shape, such as the "Crown Band" sold by the Elcon Power Connector Products Division of Tyco Electronics Corporation or the "Louvertac Band" sold by Tyco Electronics Corporation. In another implementation, the radial interposer spring 708 may be a canted coil spring, such as the canted coil springs sold by the Bal Seal Engineering Company. In other implementations, other radial interposer contact springs or circumscribing radial springs may be used as the radial interposer spring 708.

Some implementations of the radial interposer spring 708, such as the crown band implementation, may include an hourglass-shaped contact band that is fit into the socket 706. For example, the radial interposer spring 708 may include a first end portion, a middle portion, and a second end portion. The two end portions may serve to connect the radial interposer spring 708 with the inner surface of the core component 704. The middle portion may be raised away from the inner surface of the core component to make contact with the contact pin when the pin is inserted into the socket 706. For example, the middle portion of the radial interposer spring 708 may have a smaller circumference than the two end portions of the radial interposer spring 708. Therefore, when the contact pin is inserted into the socket 706, the middle portion of the radial interposer spring 708 makes contact with the contact pin as the pin travels through the radial interposer spring 708. The contact pin will apply a force to the middle portion of the radial interposer spring 708. The force may be substantially orthogonal to the surface of the contact pin. In response, the core component 704 may apply a substantially equal and opposite force to the end portions of the radial interposer spring 708 that are in contact with the inner surface of the core component 704.

Some implementations of the radial interposer spring 708, such as the Louvertac implementation, may include louver slats that are bent about their longitudinal axes. The slats may be bent so that one edge of the slat is configured make contact with the contact pin when the contact pin is inserted into the socket. The other edge of the slat is configured to make contact with the inner surface of the core component 704. Therefore, the slats complete an electrical connection between the contact pin and the core component. The contact pin will apply a force to the louvered slats. The force may be substantially orthogonal to the surface of the contact pin.

The radial interposer spring 708 may be a contact band that is formed into a substantially cylindrical shape to fit within a substantially cylindrical opening in the socket 706 of the core component 704. For example, a strip of Louvertac contact material may be curled into a generally cylindrical shape so that one side of the strip abuts the inner surface of the core component 704 and the other side is ready to make electrical contact with a contact pin inserted into the socket 706. The substantially cylindrical shape may include shapes that are generally cylindrical, but have portions that deviate from a generally cylindrical shape. For example, an hour-glass shaped crown band may have a substantially cylindrical shape. A substantially cylindrical contact band may have a generally circular cross-sectional shape. The substantially circular/cylindrical contact band may be fit into the substantially circular/cylindrical opening in the socket 706. In one implementation, the circular/cylindrical contact band is formed into a substantially complete circle inside the socket 706. In other implementations, the circular/cylindrical contact band may only form a partial circle inside the socket 706. For example, the contact band may be formed into shape with a "C" cross-sectional shape.

The slats 710 of the radial interposer spring 708 may be spring elements. As a contact pin passes through the radial interposer spring 708, the slats 710 may compress or flex in response to physical contact from the contact pin. The slats 710 may then apply a reaction force against the contact pin to maintain an electrical connection between the core component 704 and the contact pin. In implementations of the radial interposer spring 708 that include an hourglass-shaped contact band (e.g., the crown band implementation), the middle portion of the contact band is compressed when the contact pin is inserted into the socket 706. Current may flow from the core component 704 to the end portions of the crown band that make contact with the core component 704, then to the middle portion of the crown band, and finally to the contact pin. In implementations of the radial interposer spring 708 that include one or more slats bent around their longitudinal axes (e.g., the Louvertac implementation), the slats may flex when the contact pin is inserted into the socket 706. Current may flow from the core component 704 to one edge of the slats, then to the other edge of the slats, and finally to the contact pin. Because of the large number of slats 710 in the radial interposer spring 708 that make contact with the contact pin, the radial interposer spring 708 may provide a great deal of redundancy to protect against electrical disconnection.

Figure 8:
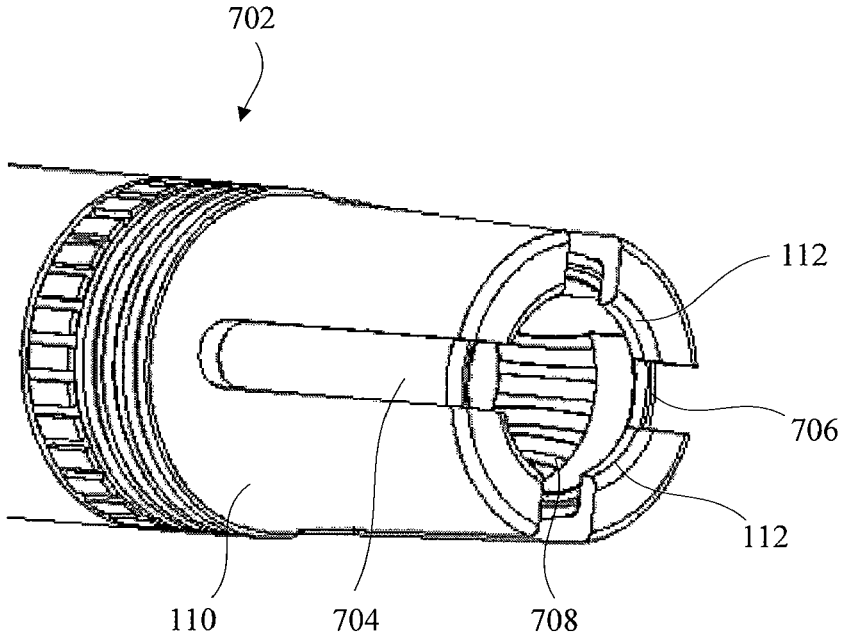
FIG. 8 illustrates a slider component disposed around the socket of FIG. 7.

FIG. 8 illustrates the slider component 110 disposed around the socket 704 of FIG. 7. The slider component 110 of FIG. 8 may be substantially similar to the slider component 110 of FIG. 1. For example, the slider component 110 may move in a longitudinal direction relative to the socket 704 to make contact with a contact pin inserted into the electrical connector 702. The slider component 110 may move forward along the electrical connector 702 in response to occurrence of a fault condition. A portion of the slider component 110 may extend over a portion of an opening of the socket 706 to hold the radial interposer spring 708 inside the socket 706.

Figure 9:
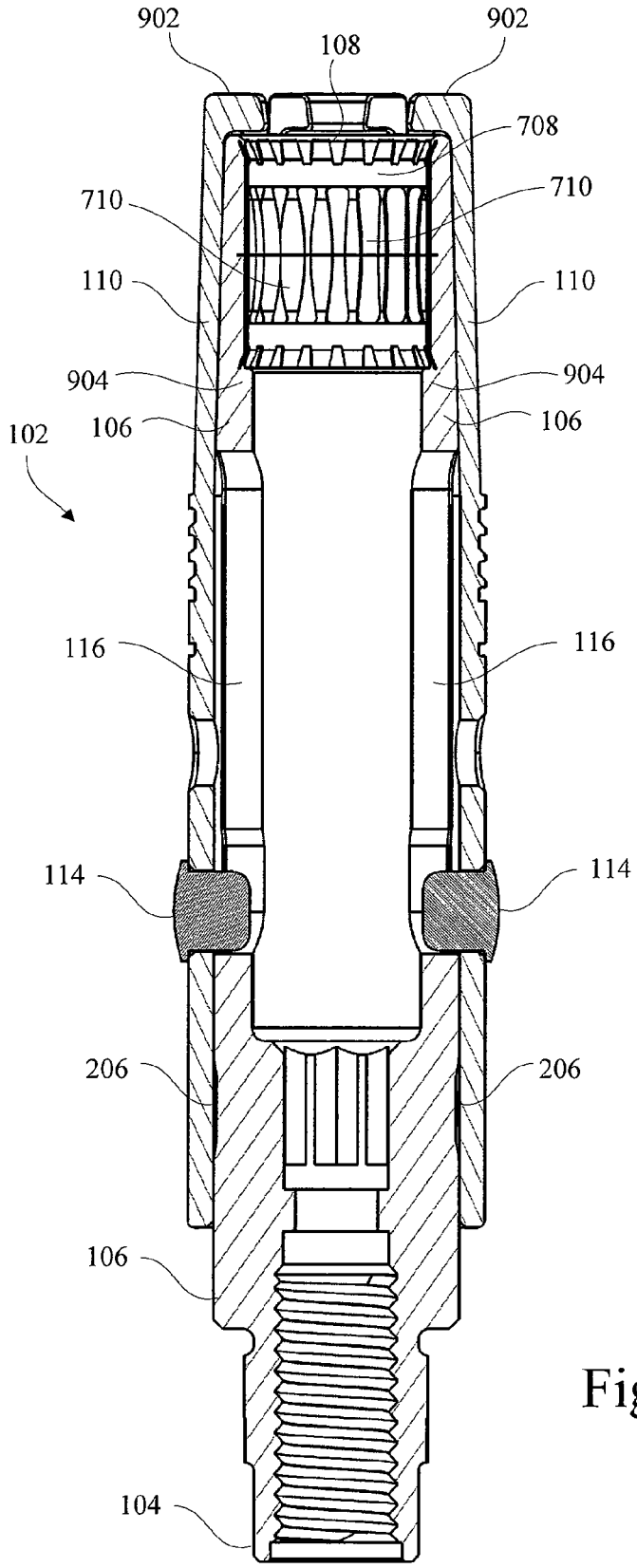
FIG. 9 illustrates a cross-sectional view of an electrical connector.

FIG. 9 illustrates a cross-sectional view of an electrical connector, such as the electrical connector 102. The slider component 110 in FIG. 9 is shown in a standard position. For example, FIG. 9 shows the electrical connector 102 before occurrence of a fault condition connection. Also visible in FIG. 9 is a protuberance and recess system serving as the connection component 206 that holds the slider component 110 in place until occurrence of a fault condition, as described above in connection with FIG. 2.

The electrical connector 102 of FIG. 9 also includes a contact band in the socket 108, such as the radial interposer spring 708 shown in FIG. 7. The radial interposer spring 708 may be held in place within a pocket formed between the core component 106 and one or more end portions 902 of the slider component 110 that extend over a portion of the opening of the socket 108. The core component 106 may include a support component 904 that serves to receive a first end of the radial interposer spring 708. The support component 904 may be a shoulder, rim, edge, recess, or other component that abuts one end of the radial interposer spring 708. The support component 904 may be formed on an inner surface of the core component 106. The one or more end portions 902 of the slider component 110 that extend over a portion of the opening of the socket 108 abut a second end of the radial interposer spring 708 and prevent the radial interposer spring 708 from being unintentionally removed from the socket 108. For example, the support component 904 forms a first end of a pocket configured to hold the radial interposer spring 708 substantially in place within the socket 108. The end portions 902 of the slider component 110 may form a second end of the pocket. In some implementations, the end portions 902 of the slider component 110 are not integrally connected with the support component 904. For example, the pocket for the radial interposer spring 708 is formed between two different components, such as a portion of the core component 106 and a portion of the slider component 110.

Figure 10:
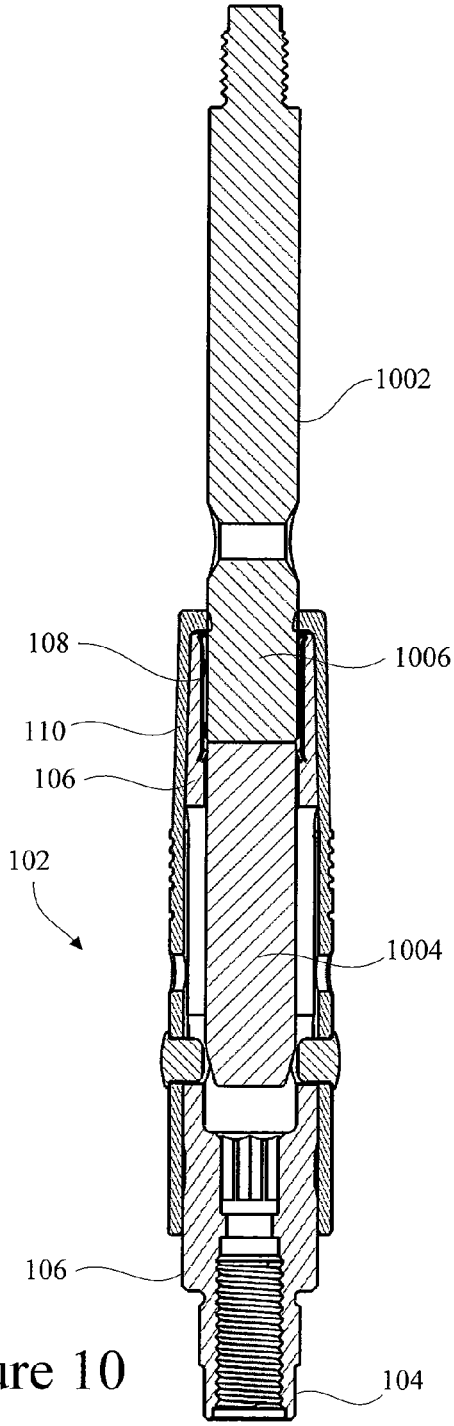
FIG. 10 illustrates a cross-sectional view of an electrical connector connected with a contact pin in a standard connection.

FIG. 10 illustrates a cross-sectional view of the electrical connector 102 connected with a contact pin 1002 in a standard connection. The contact pin 1002 may include a non-conductive tip 1004 and a conductive body portion 1006. During a standard connection, the contact pin 1002 may be inserted into the electrical connector 102 until the socket 108 makes electrical contact with the conductive body portion 1006 of the contact pin 1002. After the connection is made, a power distribution component connected with the connection terminal 104 may be electrically connected with a power line associated with the contact pin 1002.

Figure 11:
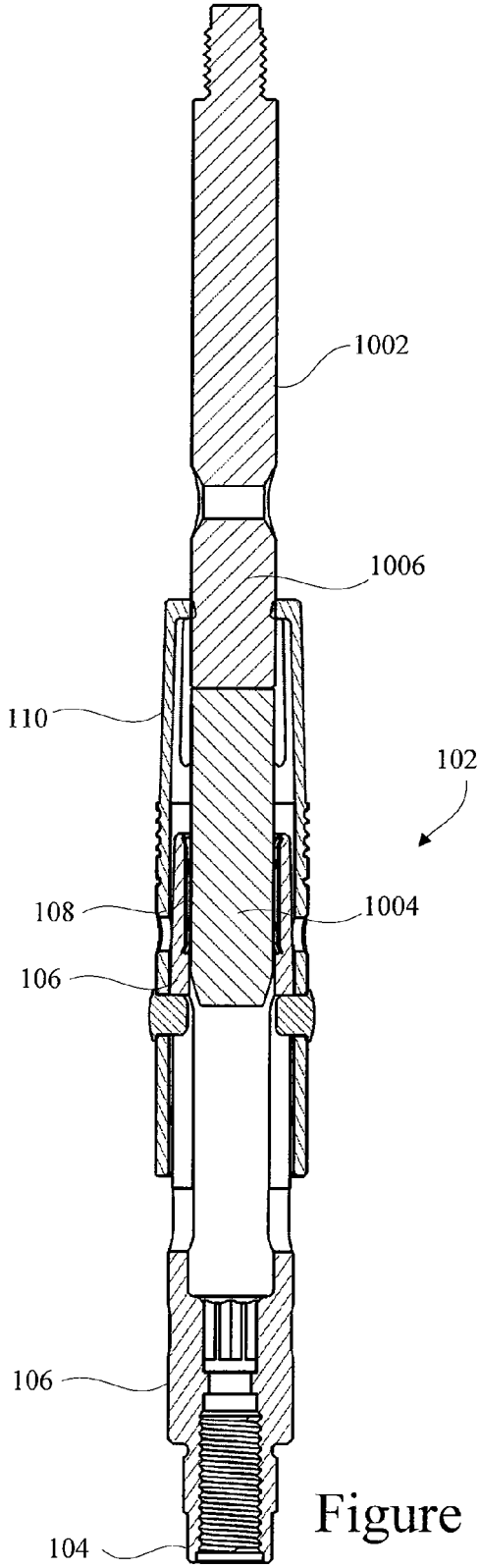
FIG. 11 illustrates a cross-sectional view of an electrical connector connected with a contact pin in a fault condition connection.

FIG. 11 illustrates a cross-sectional view of the electrical connector 102 connected with the contact pin 1002 in a fault condition connection. As the contact pin 1002 is inserted into the electrical connector 102 during a fault condition connection, an electric arc may form between the contact pin 1002 and a portion of the electrical connector 102. The arc may prevent the contact pin 1002 from being inserted into the electrical connector 102 far enough to make a connection between the socket 108 and the conductive body portion 1006 of the contact pin 1002. In response to the fault current connection, the slider component 110 may move relative to the socket 108 from a standard position to an extended position to make contact with the conductive body portion 1006 of the contact pin. Once the slider component makes contact with the conductive body portion 1006, the dangerous electric arc may be extinguished as current flows through the slider component 110 rather than through another medium, such as air.

Figure 12:
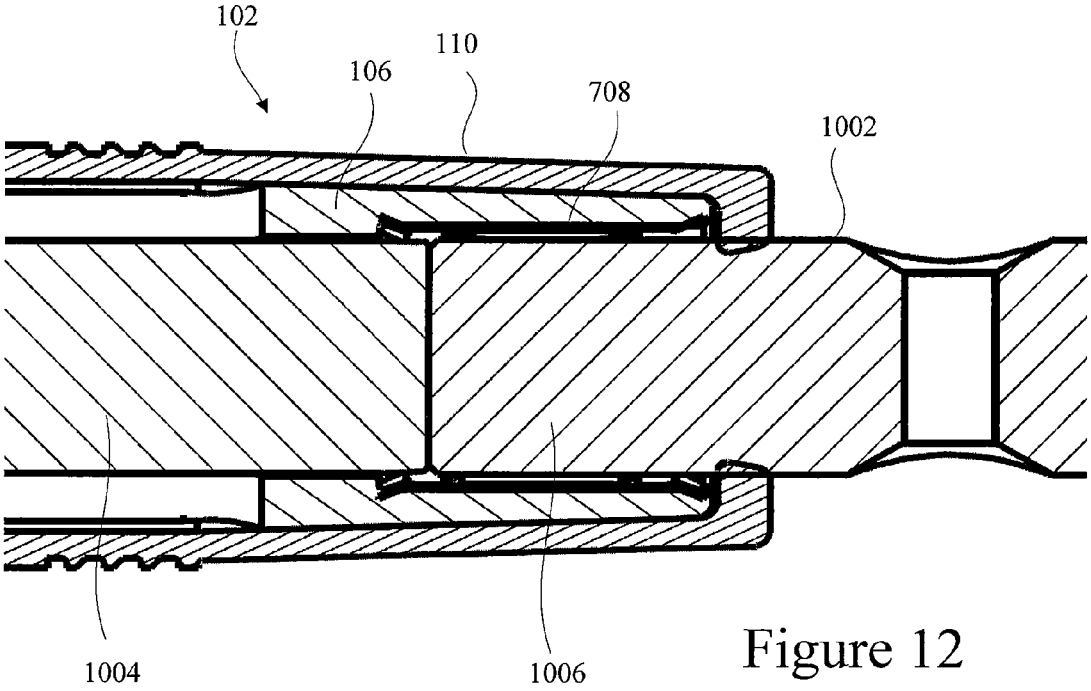
FIG. 12 illustrates a cross-sectional view of one embodiment of a connection between an electrical connector and a contact pin.
Figure 13:
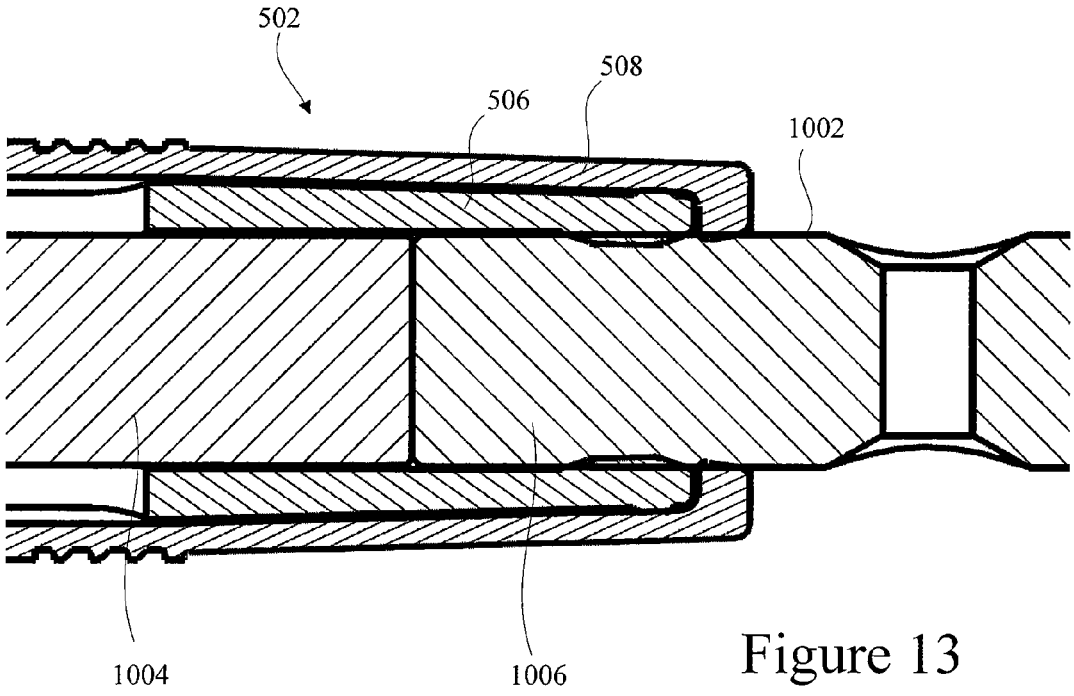
FIG. 13 illustrates a cross-sectional view of another embodiment of a connection between an electrical connector and a contact pin.

FIG. 12 illustrates a cross-sectional view of one embodiment of a connection between an electrical connector and a contact pin. In FIG. 12, the connection between the contact pin 1002 and the core component 106 is completed by a radial interposer spring 708, as shown in FIGS. 7-9. FIG. 13 illustrates a cross-sectional view of another embodiment of a connection between an electrical connector and a contact pin. In FIG. 13, the connection between the contact pin 1002 and the core component 106 is completed by a contact spring 506, as shown in FIGS. 5 and 6.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. An electrical bushing, comprising:

a socket configured to receive a contact pin and provide an electrical connection between the contact pin and a connection terminal during a standard connection, wherein the socket comprises a contact spring that is configured to make contact with the contact pin when the contact pin is inserted into the socket;

a slider component configured to move relative to the socket to make contact with the contact pin and provide an electrical connection between the connection terminal and the contact pin during a fault condition connection; and a helper spring that extends from the slider component and abuts an outer surface of the contact spring to apply a force to the contact spring.

2. The electrical bushing of claim 1, wherein the helper spring is configured to apply a force to the outer surface of the contact spring to help maintain contact between the contact spring and the contact pin.

3. The electrical bushing of claim 1, wherein the contact spring comprises a cantilever spring finger connected on one end to a body portion of the socket.

4. The electrical bushing of claim 3, wherein the helper spring comprises a cantilever spring finger connected on one end to the slider component.

5. The electrical bushing of claim 1, wherein the helper spring is formed from a different material than the contact spring.

6. The electrical bushing of claim 1, wherein the helper spring is formed from a material that is more resistant to stress relaxation than the material used to form the contact spring.

7. The electrical bushing of claim 1, wherein the contact spring is formed from copper or a copper alloy, and wherein the helper spring does not include copper or a copper alloy.

8. The electrical bushing of claim 1, wherein the contact spring carries current between the contact pin and the connection terminal during the standard connection.

9. The electrical bushing of claim 8, wherein the helper spring does not carry substantial current between the contact pin and the connection terminal during the standard connection.

10. The electrical bushing of claim 1, wherein the socket comprises a second contact spring that is configured to make contact with the contact pin when the contact pin is inserted into the socket, and wherein the helper spring abuts the outer surface of the contact spring and an outer surface of the second contact spring.

11. The electrical bushing of claim 1, wherein the socket comprises a second contact spring that is configured to make contact with the contact pin when the contact spring is inserted into the socket;

wherein the electrical bushing further comprises a second helper spring; and wherein the helper spring abuts the outer surface of the contact spring and the second helper spring abuts an outer surface of the second contact spring.

12. The electrical bushing of claim 1, further comprising:

a slot configured to guide a movement of the slider component relative to the socket;

wherein the slider component is configured to disengage from a restrained position and move along the slot relative to the socket to make contact with the contact pin and provide a current path between the connection terminal and the contact pin in response to a gas expansion force created during the fault condition connection;

wherein the helper spring comprises a cantilever spring finger connected on one end to a body portion of the slider component.

13. The electrical bushing of claim 1, wherein the helper spring moves relative to the contact spring when the slider component moves relative to the socket.

14. The electrical bushing of claim 1, wherein the connection terminal is configured to connect with a power distribution component, wherein the contact pin is configured to connect with a power line, and wherein the socket is configured to carry electricity at a voltage level that is greater than 10 kilovolts between the power distribution component and the power line.

15. The electrical bushing of claim 1, wherein the electrical bushing is configured to carry electricity at a voltage level between 15 kilovolts and 35 kilovolts between a transformer and a power line.

16. The electrical bushing of claim 1, wherein a portion of the helper spring extends past the socket in a longitudinal direction to serve as a preliminary point of arc discharge with the contact pin before the contact pin is inserted into the socket in a standard connection.

17. An electrical bushing, comprising:

means for receiving a contact pin and electrically connecting the contact pin and a connection terminal during a standard connection, wherein the means for receiving comprises a cantilever spring finger that is configured to make contact with the contact pin;

means for applying a force to the cantilever spring finger to help maintain contact between the cantilever spring finger and the contact pin;

a slider component; and means for guiding a movement of the slider component relative to the means for receiving the contact pin so that the slider component makes contact with the contact pin and provides a current path between the connection terminal and the contact pin during a fault condition connection.

18. The electrical bushing of claim 17, wherein the means for applying the force is configured to abut an outer surface of the cantilever spring finger, and wherein the means for applying the force extends from the slider component.

19. The electrical bushing of claim 17, wherein the means for applying the force is formed from a material that is more resistant to stress relaxation than the material used to form the cantilever spring finger.

20. The electrical bushing of claim 17, wherein the slider component is configured to disengage from a restrained position and move relative to the means for receiving the contact pin to make contact with the contact pin and provide the current path between the connection terminal and the contact pin in response to a gas expansion force created during the fault condition connection;

wherein the means for applying the force moves relative to the cantilever spring finger when the slider component moves relative to the means for receiving the contact pin.

21. The electrical bushing of claim 17, wherein the electrical bushing is configured to carry electricity at a voltage level greater than 10 kilovolts between a transformer and a power line.

22. An apparatus, comprising:

an electrical bushing for connecting a power distribution component with a power line, wherein the electrical bushing is configured to carry electricity at a voltage level that is greater than 10 kilovolts between the power distribution component and the power line;

wherein a connection terminal of the electrical bushing is configured to electrically connect with the power distribution component;

wherein a socket of the electrical bushing is configured to receive a contact pin associated with the power line and provide an electrical connection between the contact pin and the connection terminal, wherein the socket comprises a contact spring that is configured to make contact with the contact pin when the contact pin is inserted into the socket;

wherein a helper spring of the electrical bushing abuts the contact spring to apply a force to the contact spring to help maintain contact between the contact spring and the contact pin;

the electrical bushing further comprising:

a slider component configured to disengage from a restrained position and move relative to the socket to make contact with the contact pin and provide a current path between the connection terminal and the contact pin in response to a gas expansion force created during a fault condition connection; and a slot configured to guide a movement of the slider component relative to the socket; and wherein the helper spring comprises a cantilever spring finger connected on one end to the slider component.

23. The electrical bushing of claim 22, wherein the helper spring is formed from a material that is more resistant to stress relaxation than the material used to form the contact spring.

* * * * *